US006796707B2

(12) United States Patent
Gigas et al.

(10) Patent No.: US 6,796,707 B2
(45) Date of Patent: Sep. 28, 2004

(54) DUAL DIRECTION MIXING IMPELLER AND METHOD

(75) Inventors: Bernd Gigas, Churchville, NY (US); Richard Howk, Pittsford, NY (US)

(73) Assignee: SPX Corporation, Charlotte, NC (US)

( * ) Notice: Subject to any disclaimer, the term of this patent is extended or adjusted under 35 U.S.C. 154(b) by 65 days.

(21) Appl. No.: 10/082,222

(22) Filed: Feb. 26, 2002

(65) Prior Publication Data

US 2003/0161216 A1 Aug. 28, 2003

(51) Int. Cl.[7] ..... B01F 7/22

(52) U.S. Cl. ..... 366/327.1; 366/327.4; 366/330.1; 366/329.2

(58) Field of Search ..... 366/327.1, 327.2, 366/327.3, 327.4, 325.1, 329.2, 330.1, 330.3, 330.5, 330.4; 416/237

(56) References Cited

U.S. PATENT DOCUMENTS 3,365,176 A 1/1968 Christensen
3,374,989 A 3/1968 Todtenhaupt
4,238,159 A * 12/1980 Tielens et al. ..... 366/327.2
5,052,892 A * 10/1991 Fasano ..... 416/204 R

FOREIGN PATENT DOCUMENTS

| | | |
|---|---|---|
| DE | 1101113 | 3/1961 |
| DE | 19952760 | 5/2001 |
| EP | 0305576 | 3/1989 |
| JP | 2-273531 A * | 11/1990 |

OTHER PUBLICATIONS

International Searching Authority, International Search Report, Jun. 23, 2003.

* cited by examiner

*Primary Examiner*—Terry K. Cecil
(74) *Attorney, Agent, or Firm*—Baker & Hostetler LLP

(57) ABSTRACT

A two bladed dual direction impeller includes blades that each have an inner blade portion that forces material in a first direction and a second blade portion that forces material in a second direction opposite to the first direction. The first and second blade portions are radially spaced from each other by a connector element. Either one or both of the blade portions may be twisted.

6 Claims, 3 Drawing Sheets

DUAL DIRECTION MIXING IMPELLER AND METHOD

FIELD OF THE INVENTION

The present invention relates to a rotating impeller for use in mixing vessels. More particularly, the invention pertains to a dual direction, counter flow, impeller that produces flow in two opposite directions.

BACKGROUND OF THE INVENTION

It is known in many industrial applications to have a mixing vessel that contains a material to be mixed. A rotating shaft extends into the vessel and rotates one or more generally radially extending impellers in order to cause flow in the material to mix the material. Such mixers are used in many industrial and manufacturing applications, including some applications for mixing medium to high viscosity materials. For these materials it is often necessary to perform the mixing in a laminar or transient flow environment. It is desirable to effect a proper mixing, while reducing the amount of energy that needs to be imparted to the material. Reducing the amount of energy imported helps to reduce the mechanical stresses on the impeller, the impeller shaft, and the drive system. Reducing the input energy applied to the material in the regions of the blades can also reduce the shear forces or other undesirable effects that can occur on shear sensitive materials when they are subjected to high shear forces.

One solution to mixing medium and high viscosity materials has been to use a radial impeller that has a blade angled in one direction. The blade extends less than the full radial distance from the shaft to the outside of the tank and pumps the material in one direction, for example, downwardly. Two sets of impeller blades may be disposed at different axial heights on the shaft. This arrangement will push the material in the downward direction in the area radially near the shaft and defined generally by the radial length of the blade. The material then flows horizontally outward at the lower part of the vessel and flows generally upward in a radial area generally between the blade tips of the vessel wall. Upon reaching near the top of the vessel, the material flows radially inwardly and then is pumped downward again by the blades.

A disadvantage of this one-directional blade arrangement is that the energy required for the complete flow cycle is to be applied during only less than half of the flow cycle. In some situations, particularly, for medium and high viscosity materials, this can cause undesirable turbulent flow near the blades, and/or shear effects on the material, and incomplete vessel motion.

Another approach to this problem has been to provide a so-called dual direction impeller which has a first radial segment that pumps fluid in one direction, (e.g., downwardly). Attached at the end of the first segment is a second segment oriented in the other direction that pumps fluid in the other direction (e.g., upwardly). A disadvantage of the known dual direction systems is that because the first segment is connected directly to the second segment, an area of undesirable turbulence and/or radial flow exists in the region where the two blade segments are connected. Turbulence arises because one blade segment is forcing material in one direction and is immediately adjacent to the other segment which is forcing the material in the other direction. Consequently, flow inducing forces are not efficiently transmitted in the region of connection of the two oppositely angled blades. Further, these known arrangements have not taken advantage of the desirable properties that can be gained from using a twisted or curved blade segment.

Accordingly, there is a need in the art for an improved dual direction impeller assembly that can in some embodiments provide improved performance compared to existing dual direction impellers.

SUMMARY OF THE INVENTION

It is therefor a feature and advantage of the present invention to provide an improved dual direction impeller assembly that can in some embodiments provide improved performance compared to existing dual direction impellers.

The above and other features and advantages are achieved through the use of a novel dual direction mixing impeller and method as herein disclosed. In accordance with one embodiment of the present invention, an impeller blade for use in a mixing vessel has an inner blade portion angled in a first direction an outer blade portion disposed radially outward from the inner blade portion and a connector element that provides radial spacing between respective inner and outer blade portions.

In accordance with another aspect, an impeller for use in a mixing vessel, has a hub at least two inner blade portions extending from the hub and at least two outer blade portions disposed radially outward from respective inner blade portions. A connector element provides radial spacing between the respective inner and outer blade portions.

In accordance with another aspect, an impeller for use in a mixing vessel has at least two inner blade portions angled in a first direction at least two outer blade portions disposed radially outward from respective inner blade portions, and means for providing radial spacing between the respective inner and outer blade portions.

In accordance with yet another aspect, a method is provided for mixing material in a mixing vessel using an impeller. The method includes the steps of pumping the fluid in a first direction using a blade that extends radially from a hub and forcing the material in a second direction opposite to the first direction using a second blade that is connected to the first blade with a radial space provided between the first and second blades.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
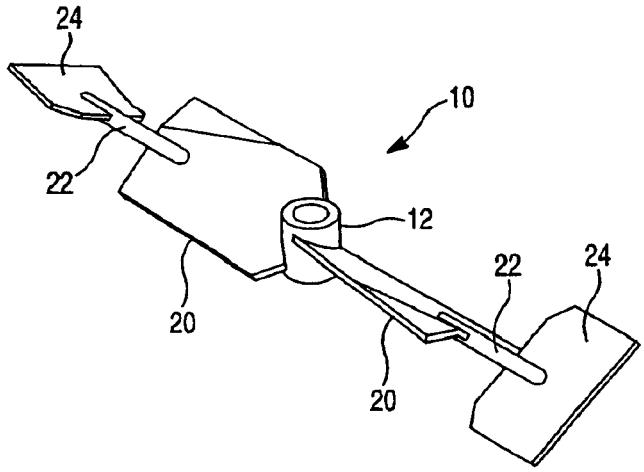
FIG. 1 is a perspective view of a two bladed, dual direction, impeller in accordance with a preferred embodiment of the present invention.

A two bladed dual direction impeller includes blades that each have an inner blade portion that forces material in a first direction and an outer blade portion that forces material in a second direction opposite to the first direction. The inner and outer blade portions are radially spaced by a connector element. Either one or both of the blade portions may be twisted.

FIGS. 1–6 illustrate a presently preferred embodiment of the present invention. A two bladed impeller 10 includes a hub 12 having a bore 14 which can be mounted along an impeller shaft, and a key hole 16 for fixing the impeller 10 to rotate with the shaft. The impeller 10 includes two opposed inner blades 20, a connecting rod 22 extending from each of the blades 20, and a outer blade 24 connected by the connecting rod 22 as shown.

The connecting rod 22 is made small enough so it can have a minimal or insignificant effect on flow in the radial region of the connecting rod 22. Accordingly, the inner blade 20 pumps material in a first direction at the radial region of the inner blade 20. The outer blade 24 is angled in the opposite direction of the inner blade 20 so that it moves material in a flow direction opposite the flow direction imparted by the inner blade 20. The material will flow in this opposite direction generally in the radial region of the outer blade 24.

The connector 22 provides for an intermediate spacing region between the inner blade 20 and the outer blade 24, which is in a radial region of the boundary between the two flow directions. This provides significant advantages of the present invention. Because no particular blade direction is located in the boundary region where the connector 22 is located, turbulence and radial flow in this region can be reduced. This reduces the adverse effects of shear turbulence and/or radial flow of the material that could otherwise occur if the blades 20 and 24 were immediately adjacent each other. Moreover, the surface area of their blades 20 and 24 are located substantially within their respective flow direction areas. This means that energy can be transferred efficiently from the blades to the material along the lengths of the blades 20 and 24. This efficient energy transfer allows less energy overall to be directed into the material for the same mixing action as compared to the prior art devices having the blades 20 and 24 immediately adjacent each other. This more efficient energy transfer can provide benefits such as reducing the size of the motor required to mix the fluid, reducing the stresses on the motor transmission shaft and impeller, and therefore permitting lighter, less expensive, and/or less bulky components to be used to effect the same degree of mixing in a specific application compared to the prior art. Therefore, the spacing between the blades 20 and 24 provided by the connecting rod 22 provides significant benefits both in reducing shear, turbulence, radial flow and/or high energy effects on the material, and in requiring less energy and force to be applied through the mixing system to accomplish the same degree of mixing flow.

Figure 2:
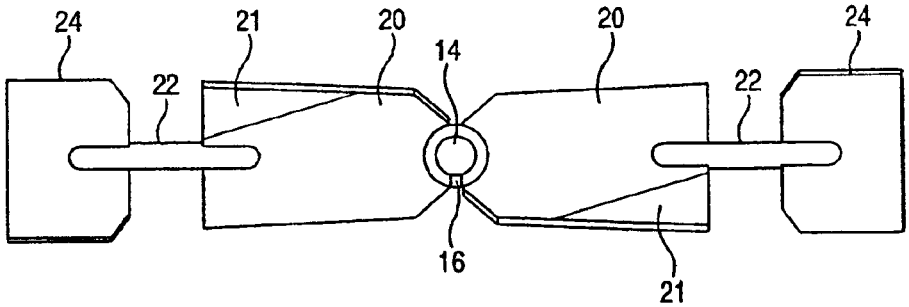
FIG. 2 is a top view of the impeller shown in FIG. 1.
Figure 3:
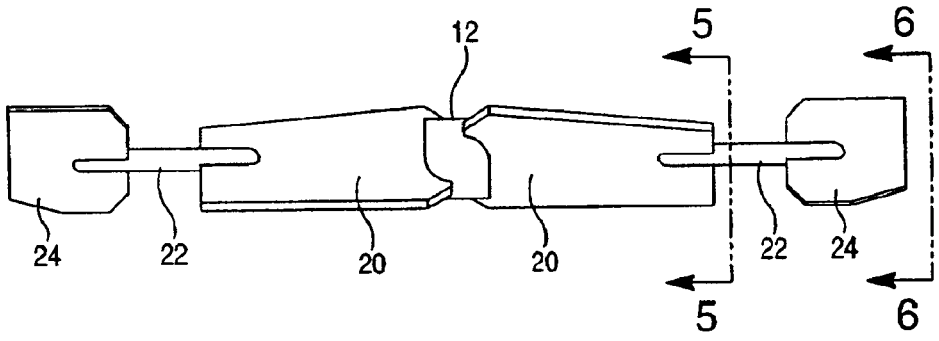
FIG. 3 is a side view of the impeller shown in FIG. 1.
Figure 4:
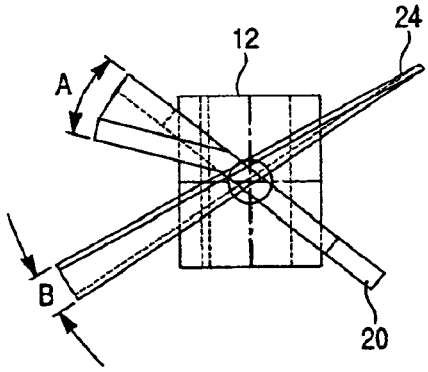
FIG. 4 is an end view of the impeller shown in FIG. 1, showing only one half of the impeller.
Figure 5:
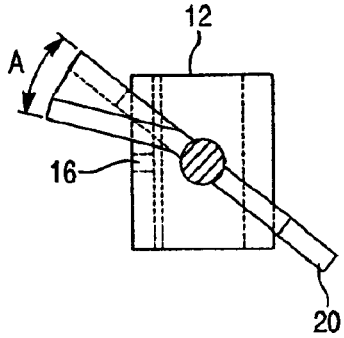
FIG. 5 is a cross-sectional view taken along line 5—5 in FIG. 3 showing only one half of the impeller.
Figure 6:
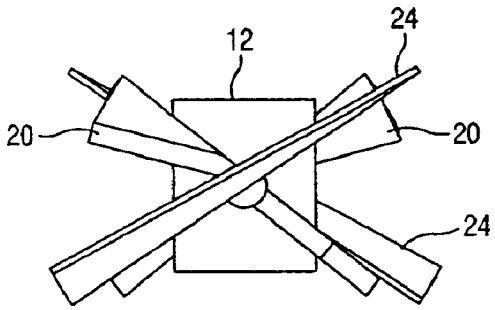
FIG. 6 is an end view of the impeller shown in FIG. 1.

In the preferred embodiment, the inner blade 20 is not completely planar, but has a twisted section generally illustrated as 21 in FIG. 2. The twisted section includes an area where the angle of attack of the blade is gradually changing along the section 21, as indicated by the angle A in FIGS. 4 and 5. Also in the preferred embodiment, the outer blade 24 is twisted along its length, so that the angle of attack displayed changes along its radial length. This is illustrated by angle B in FIG. 4. The use of twisted blades 20 and 24 can provide more efficient pumping, because the angle of attack can be made less in the more radially outward positions. Since the blade speed becomes greater moving radially outward along the blade, this allows the longitudinal mixing force being applied to be balanced as desired along the length of the blade.

Figure 7:
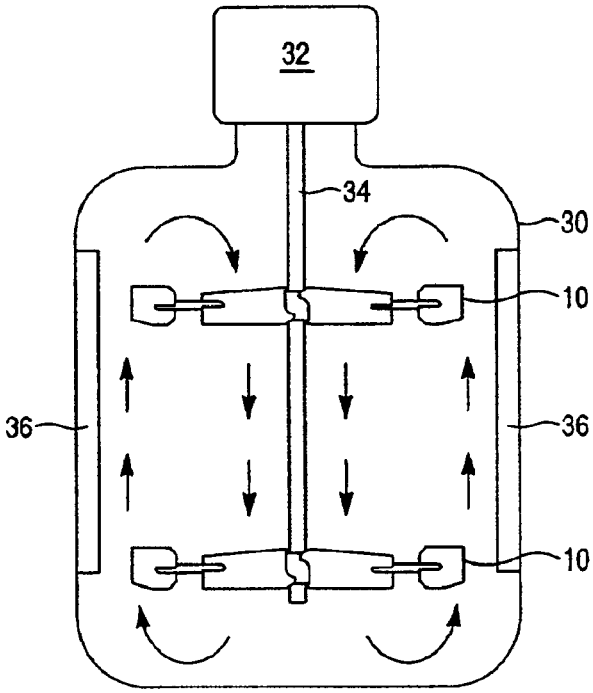
FIG. 7 is a schematic view of a mixing apparatus utilizing the impeller of FIG. 1, and showing the general flow path of the material being mixed.

FIG. 7 is a schematic diagram illustrating the general arrangement of a mixer including impellers according to the present invention. FIG. 7 illustrates two impellers 10 utilized within a mixing vessel 30. A motor 32 drives an impeller shaft 34 that supports the impeller 10. Flow is achieved in general as illustrated by the arrows in FIG. 6. The vessel 30 may also include longitudinal baffles 36 projecting inwardly to the vessel wall that reduce rotational flow of the materials and thus tend to enhance the vertical vectors of movement.

The present invention is particularly suitable with relatively medium to high viscosity liquids holding these with solids therein. Because of the desirable novel features of the invention, mixing can be accomplished very efficiently, and the speed of rotation of the impellers can be kept desirably low. The invention is particularly suitable for materials such as pseudo-plastic materials that do not keep constant viscosity, and is useful in the manufacture of personal care products, polymer solutions, and/or highly concentrated slurries. Because embodiments of the invention can avoid imparting high energy locally in the blade regions, it is also particularly suitable for mixing materials having crystals, and for applications such as mammalian cell fermentations where it is desirable not to kill the cells. The invention can also provide the benefit of achieving higher flow when the same power is being applied to the system compared to prior art impellers. A significant benefit of the invention is the ability in some embodiments to provide overall fluid motion without undesirably high localized turbulence, which is particularly beneficial for elevated viscosity transient flow fluids and/or shear sensitive materials.

By way of example only, the impeller is well suited for applications having a Reynolds number greater than 20 but below 500. However, in some circumstances, the invention may perform well at Reynolds numbers beyond this range.

The ratio of the radial length of the inner blade 20 to the outer blade 24, and the degree of spacing provided by the connector 22, can be selected depending upon the proper application. In one preferred embodiment, used in a 17½ inch tank, the inner blade has a radial length of 4.94 inches and each outer blade has the length of 2.25 inches radially.

A gap of approximately two thirds to one half of the outer blade radial length is provided by the connector 22. These dimensions are by way of example only, and other dimensions and ratios may be applied beneficially with the present invention. In the embodiment described the inner blade angle is 38 degrees in the downpumping direction, with 10 degrees of twist, and the outer blade angle is 32 degrees in the up pumping direction with five degrees of twist. These dimensions can also be varied as desirable depending on the overall blade configuration and application.

The preferred embodiment has two opposed multi-part "blades" each blade having the two segments and the connector. Impellers according to the invention can also be contracted with three or more multi-part blades.

The many features and advantages of the invention are apparent from the detailed specification, and thus, it is intended by the appended claims to cover all such features and advantages of the invention which fall within the true spirits and cope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An impeller for use in a mixing vessel, comprising:

a hub;

an inner blade portion extending directly from the hub and angled in a first direction, and said inner blade portion comprising a planar first portion and a twisted second portion, wherein the angle of attack of the inner blade portion gradually changes along a radial length of the twisted second portion;

an outer blade portion disposed radially outward from the inner blade portion, the outer blade portion being twisted to have a gradually changing angle of attack along its radial length less than the angle of attack of said inner blade portion; and a connector element connected to both said inner and outer blade portions providing radial spacing between respective inner and outer blade portions, wherein the inner blade portion has a radial length that is longer than a radial length of the outer blade portion, and wherein the outer blade portion is angled in a second direction opposite to the first direction.

2. An impeller according to claim 1, wherein the connector element is a cylindrical rod.

3. An impeller for use in a mixing vessel, comprising:

a hub;

at least two inner blade portions extending directly radially outward from the hub and angled in a first direction, each said inner blade portion comprising a planar first portion and a twisted second portion, wherein the angle of attack of the inner blade portion gradually changes along a radial length of the twisted second portion;

at least two outer blade portions disposed radially outward from respective inner blade portions, each said outer blade portion being twisted to have a gradually changing angle of attack along its radial length less than the angle of attack of each said inner blade portion; and at least two connector elements, each connected to a respective inner and outer blade portion to provide radial spacing therebetween, a wherein each inner blade portion has a radial length that is longer than a radial length of each outer blade portion, and wherein the outer blade portions are angled in a second direction opposite to the first direction.

4. An impeller according to claim 3, wherein said at least two connector elements are cylindrical rods.

5. An impeller for use in a mixing vessel, comprising:

a hub;

at least two inner blade portions extending directly from the hub and angled in a first direction, each said inner blade portion comprising a planar first portion and a twisted second portion, wherein the angle of attack of the inner blade portion gradually changes along a radial length of the twisted second portion;

at least two outer blade portions disposed radially outward from respective inner blade portions, and each said outer blade portion being twisted to have a gradually changing angle of attack along its radial length less than the angle of attack of each said inner blade portion; and means for providing radial spacing between respective inner and outer blade portions, wherein each inner blade portion has a radial length that is longer than a radial length of each outer blade portion, and wherein the outer blade portions are angled in a second direction opposite to the first direction.

6. An impeller according to claim 5, wherein the means for providing radial spacing is a cylindrical rod.

* * * * *